United States Patent [19]

Swietlik et al.

[11] 3,956,148

[45] May 11, 1976

[54] LUBRICATING OIL COMPOSITIONS

[75] Inventors: Joseph Marian Swietlik, Reading; Michael David Sexton, Oxford, both of England

[73] Assignee: Exxon Research and Engineering Company, Linden, N.J.

[22] Filed: Mar. 5, 1975

[21] Appl. No.: 555,362

[30] Foreign Application Priority Data

Mar. 13, 1974 United Kingdom ..... 11157/74

[52] U.S. Cl. ..... 252/47.5; 252/51.5 R; 252/402; 252/403

[51] Int. Cl.[2] ..... C10M 1/38; C10M 3/32; C10M 1/32; C10M 3/26

[58] Field of Search ..... 252/47.5, 51.5 R, 402, 252/403

[56] References Cited

UNITED STATES PATENTS

| | | | |
|---|---|---|---|
| 2,523,100 | 9/1950 | Eby | 252/47.5 |
| 2,842,498 | 7/1958 | Darling | 252/51.5 R |
| 2,928,876 | 3/1960 | Spivak et al. | 252/51.5 R |
| 2,962,531 | 11/1960 | Coffield | 252/51.5 R |
| 3,036,003 | 5/1962 | Verdol | 252/51.5 R |
| 3,214,376 | 10/1965 | Morivay | 252/51.5 R |
| 3,630,900 | 12/1971 | VanDerVoort | 252/47.5 |
| 3,673,091 | 6/1972 | Werzner | 252/51.5 R |
| 3,844,956 | 10/1974 | Nnadi | 252/47.5 |

*Primary Examiner*—Delbert E. Gantz
*Assistant Examiner*—I. Vaughn
*Attorney, Agent, or Firm*—Frank T. Johmann

[57] ABSTRACT

A lubricating oil composition comprising a lubricating oil and the product derived from the reaction of (1) hexamethylene tetramine with (2) a phenol, a methylene bis-phenol or a sulphurised phenol provided that in said phenol, methylene bis-phenol or sulphurised phenol at least one of the 2,4 and 6 positions of the phenol aromatic ring is unsubstituted. In such lubricating oils the reaction product acts as an ashless detergent.

9 Claims, No Drawings

LUBRICATING OIL COMPOSITIONS

This invention relates to lubricating oil compositions containing an additive acting as an ashless basic detergent.

According to this invention a lubricating oil composition comprises a lubricating oil and the product derived from the reaction of (1) hexamethylenetetramine (Hexamine) with (2) a phenol, a methylene bis-phenol, or a sulphurised phenol provided that in said phenol, methylene bis-phenol or sulphurised phenol at least one of the 2,4 and 6 positions of the phenol aromatic ring is unsubstituted.

Although the product can be derived from phenol itself it is preferred that a phenol be used which has attached to the aromatic nucleus one or more groups containing hydrogen and carbon atoms. Such attached groups may be hydrocarbyl, that is containing only hydrogen and carbon atoms, and these are preferably alkyl groups but may also be cycloalkyl, alkenyl, alkynyl, aromatic or a substituted aromatic group such as an alkaryl or aralkyl group. The attached hydrogen - and carbon-containing groups may also contain substituent groups or atoms comprising nitrogen, halogen, oxygen or sulphur atoms. Alternatively, the hydrogen - and carbon-containing group may be bonded to the aromatic ring by a keto or thioketo group. As another alternative the hydrogen - and carbon-containing group may be bonded to the aromatic nucleus by an oxygen, sulphur, or nitrogen atom. Thus, the hydrogen - and carbon-containing group may also be alkoxy, cycloalkoxy, phenoxy, substituted phenoxy, mercaptide, thiophenoxy, substituted thiophenoxy, monoalkyl amino, dialkylamino, monoarylamino or diaryl amino.

The total number of carbon atoms in the phenol can vary between 6 and 200 but the preferred number of carbon atoms is 10 to 30 per molecule.

The types of phenol from which the reaction product may be derived include:

i. Substituted phenols of the type

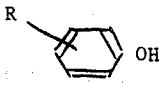

where R is a hydrocarbon substituent as defined above and can be substituted at any position in the phenol ring e.g.: o-cresol, m-cresol, p-cresol, 2-ethylphenol, 3-ethylphenol, 4-ethylphenol 2-n-propylphenol, 4-n-propylphenol, 4-iso-propylphenol, 4-n-butylphenol, 4-sec-butylphenol, 2-t-butylphenol, 4-t-butylphenol, 4-n-pentylphenol, 2-nonylphenol, 2-dodecylphenol, 4-dodecylphenol, 2-octadecylphenol, 4-octadecylphenol, 2-cyclohexylphenol, 4-cyclohexylphenol, 2-allylphenol, 4-allylphenol, o-hydroxydiphenyl, p-hydroxydiphenyl, 4-methyl - 4′-hydroxydiphenyl, o-methoxyphenol, p-methoxyphenol, p-phenoxyphenol, 2-hydroxyphenyl methyl sulphide, 4-hydroxyphenyl methyl sulphide, 2-hydroxy-diphenyl sulphide, 4-hydroxy diphenylsulphide, 2-hydroxyphenylmethylamine, 4-hydroxyphenylmethylamine, 4-hydroxyphenyldimethylamine etc. Also included are alkyl phenols where the alkyl group is obtained by polymerisation of a low molecular weight olefin e.g.: polypropylphenol, polyisobutylphenol etc.

ii. Di-substituted phenols of the type:

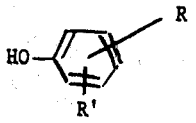

where R and R′ are hydrocarbon substituents as defined above, and where R and R′ may be the same or different, and where R and R′ may be substituted at any position in the aromatic ring e.g.: 2,3-dimethylphenol, 2,4-dimethylphenol, 2,5-dimethylphenol, 2,6-dimethylphenol; 3,4-dimethylphenol etc. 2,6-Di-n-propyl phenol, 2,6-di-n-butyl phenol, 2,6-di-sec-butyl phenol; 2,6-di-tert-butyl phenol; 2,4-di-tert-butyl phenol; 2,6-di-allyl phenol; 2,4 di-cyclohexylphenol: 2-methyl-5-isopropylphenol; 2-isopropyl-5-methylphenol, 2,6-dimethoxyphenol, 2-methoxy-4-6-butylphenol; 2-t-butyl-4-dimethylaminophenol etc.

iii. Trisubstituted phenols of the type:

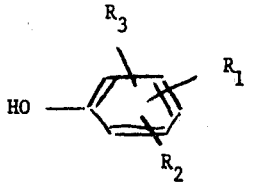

where $R_1$, $R_2$, $R_3$ are hydrocarbon substituents as defined above and where $R_1$, $R_2$, $R_3$ may or may not be the same and where the substitution pattern of the groups is 2,3,4; 2,3,5; 2,3,6; 2,4,5; 3,4,5; eg 2,3,4 trimethylphenol; 2,3,5 -trimethylphenol; 2,6-di-t-butyl-3-methylphenol; 2,6-di-t-butyl -3-methoxyphenol etc.

iv. Tetrasubstituted phenols of the type:

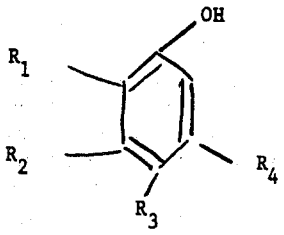

and

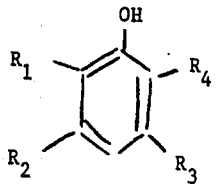

where $R_1$, $R_2$, $R_3$, and $R_4$ are hydrocarbon substitutents as defined above and where $R_1$, $R_2$, $R_3$ and $R_4$ may be the same or different, eg:

2,3,4,5-tetramethylphenol; 4-t-butyl-2,3,5-trimethylphenol; 2,6-di-t-butyl-3,5-dimethylphenol etc.

v. Phenols of the type

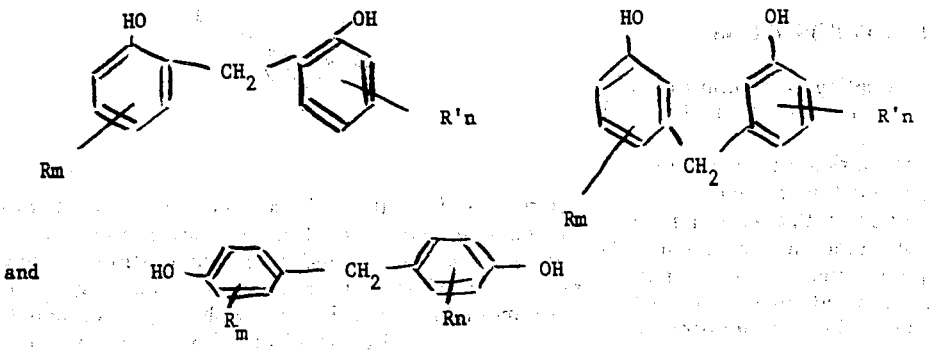

where R and R′ are hydrocarbon substituents as defined above which may or may not be different and m=n=1 or n>1 and/or m>1 with the proviso that one of the ortho or para positions on one of the phenol aromatic rings remains ubsubstituted eg: 22′-dihydroxy-55′-dimethyldiphenylmethane; 55′-dihydroxy-22′-dimethyldiphenylmethane; 44′-dihydroxy-22′-dimethyldiphenylmethane; 22′-dihydroxy-55′-dinonyldiphenylmethane; 22′-dihydroxy-55′-didodecyldiphenylmethane; 33′-di-t-butyl-44′-dihydroxydiphenylmethane; 22′44′-tetra-t-butyl-33′-dihydroxydiphenylmethane etc.

vi. Phenols of the type:

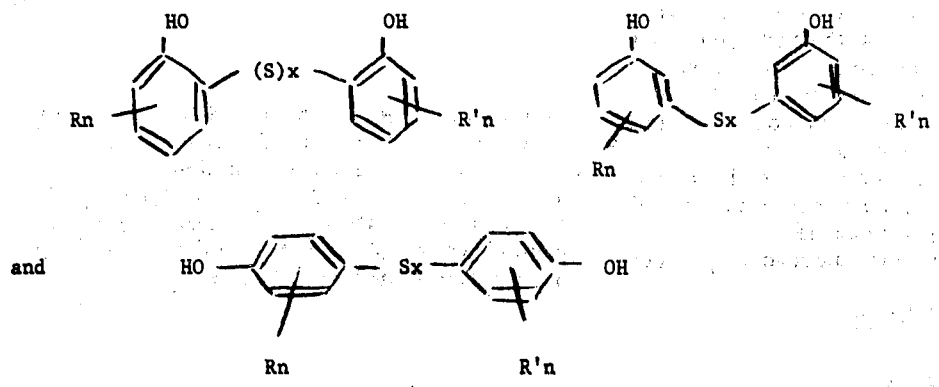

where R and R′ are hydrocarbon substituents as defined above which may or may not be different and m=n=1 alternatively $m>1$ and/or $n>1$ with the proviso that one of the positions on one of the aromatic ring that is ortho or para to the hydroxyl group remains unsubstituted. $x$ may be 1,2,3 or 4. Examples of such phenols include: 22′-dihydroxy-55′-dimethyldiphenylsulphide; 55′-dihydroxy-22′-di-t-butyldiphenyldisulphide; 44′-dihydroxy - 33′-di-t-butyldiphenylsulphide; 22′-dihydroxy-55′-dinonyldiphenyldisulphide; 22′-dihydroxy-55′-dinonyldiphenylsulphide; 22′-dihydroxy-55′-didodecyldiphenylsulphide; 22′-dihydroxy-55′-didodecyldiphenyldisulphide; 22′dihydroxy-55′-didodecyldiphenyltrisulphide; 22′-dihydroxy-55′-didodecyldiphenyltetrasulphide.

vii. A mixture of phenols of the types outlined in (i) - (vi). The mixture of phenols may consist of any number of phenols from any number of the different types outlined above. Alternatively the phenols may be a mixture of phenols of similar structure as for example the mixture of sulphurised phenols that is obtained by reaction of sulphur or sulphur halides with a simple phenol. Alternatively the mixture may contain inert phenols that do not react with hexamine as for example the mixture of t-butyl phenols obtained from the reaction of isobutylene with phenol that will contain the inert 2,4,6 tri-t-butylphenol.

The product may be prepared by reacting a phenol as described above with hexamine. The molar ratio of hexamine: phenol may be from 1:10 to 2:1 although high levels of hexamine will require the excess hexamine to be removed from the reaction mixture. Thus, the preferred reaction ratio is 1:3 to 1:6. The reaction temperature is preferably 100°–150°C, lower temperatures can be used but result in a very slow reaction, and higher temperatures give products that have only a low nitrogen content. The time for heating of the reaction mixture may vary between 0.5 hrs and 60 hrs but at the preferred temperature of reaction the preferred time for reaction is 3–5 hrs. Prolonged heating of the reaction mixture gives products with low nitrogen content.

If desired the reaction mixture may be sparged with an inert gas (eg nitrogen) during heating to facilitate the removal of the basic gases formed by the reaction.

Although the preferred method is to carry out the reaction without a solvent, if desired a solvent may be used. Any solvent used should not react with the phenol or hexamine and should be sufficiently volatile to be removed from the reaction vessel by distillation at the end of the reaction. Thus, the preferred boiling point of the solvent is 100°–200°C. Suitable solvents include heptane, octane, nonane, decane, propanol, butanol amyl alcohol, hexyl alcohol, cyclohexanol, 2-methoxyethanol 2-ethyoxyethanol, 2-butoxyethanol, toluene, xylene, mextylene etc.

The product when formed is generally diluted with a mineral oil to give a solution that is mobile and hence easily handled. The mineral oil may constitute between 0–95% of the final product but the preferred level is 5–25% of the final product. The final product may be added to a lubricating oil in any proportion from 0.01–50% by weight although the preferred level is from 0.5–5.0% by weight.

The structure of the products derived from the reaction of hexamethylenetetramine and the phenol cannot be described accurately since a mixture of products is formed and the precise composition of the mixture depends upon the reaction conditions used. However, without limiting the scope of this invention to any specific structure, we believe that the type of product formed depends upon the substitution pattern of the phenol used. Thus when two or three of the ortho/para positions on the phenol ring are unsubstituted, reaction of the phenol with hexamine gives polymeric products e.g.:

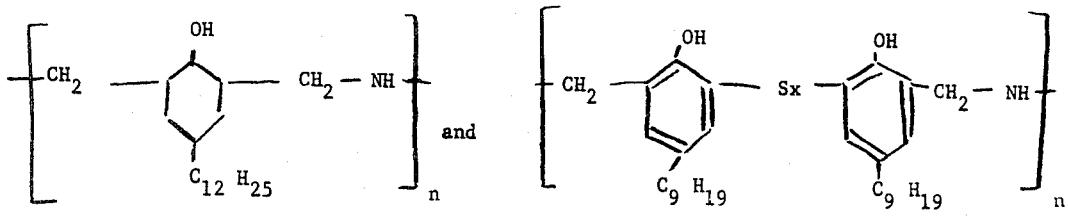

where n = 1,2,3,4 etc.

However, when only one of the ortho/para positions on the phenol is unsubstituted then reaction with hexamine gives simple dimers e.g.:

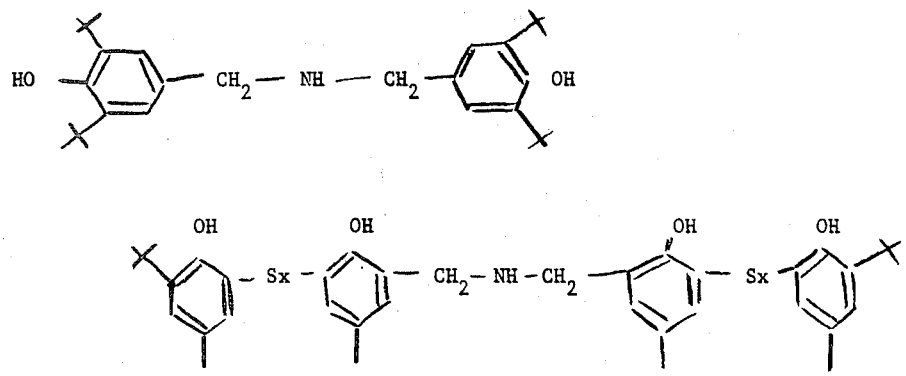

EXAMPLE 1

A mixture of ortho-t-butylphenol (244.5g 1.5 moles; 92% AI product) hexamine (35g 0.25 moles) and mineral oil (40g)* was heated at 120°C for 3 hrs. A slow stream of nitrogen was passed through the reaction mixture during the reaction. The product was filtered through a diatomaceous earth to give a light amber, clear, oil soluble additive.

Yield = 300g

%N = 3.3

TBN (Castrol) = 91.2 mgs KOH/grm.

*In these Examples the mineral oil used was a paraffinic base oil with viscosity 150 SSU at 100°F.

EXAMPLE 2

A mixture of Ethyl 733 (324g 1.5 moles; a mixture of phenols containing 75% 2.6-di-t-butylphenol) hexamine (30g 0.214 moles) and mineral oil (89g) was heated at 120°C for 5 hrs while a slow stream of nitrogen was passed through the reaction mixture. The product was filtered through the diatomaceous earth to yield a bright fluid additive.

Yield = 386grms

%N = 2.64

TBN (Castrol) = 57mgs KOH/grm.

EXAMPLE 3

Dodecylphenol (524g 2 moles) hexamine (46.6grms 0.33 moles) and mineral oil (152 grms) were stirred and heated together, with a slow stream of nitrogen passing through the reaction mixture. After 3 hrs at 120°C the residue was filtered through a diatomaceous earth to give a light amber, viscous, oil soluble product

%N = 1.74

TBN (Castrol) = 67.8 mgs KOH/grm.

EXAMPLE 4

A mixture of nonylphenyl sulphide (318g; a 70% AI product made by the reaction of $S_2Cl_2/SCl_2$ with nonylphenol in mineral oil) and hexamine (14g 0.1 moles) was heated at 120°C for 3 hrs with stirring. The residue was filtered through a diatomaceous earth to give dark, bright, viscous, oil soluble product:

TBN = 51.4 mgs KOH/grm %N = 1.31

EXAMPLE 5

A mixture of dodecylphenol sulphide (3164g; a product made by the reaction of sulphur dichloride on dodecylphenol in mineral oil) and hexamine was heated and stirred at 120°C for 3 hrs. During the reaction a slow stream of nitrogen was passed through the reaction mixture. The residue was filtered through a diatomaceous earth to yield a bright viscous oil soluble product TBN = 34.4 mgs KOH/grm.

EXAMPLE 6

A mixture of dodecylphenol (262g 1 mole) hexamine (25g 0.18 moles) and 2-ethoxyethanol (200 ccs) was heated to reflux. for 7 hrs and a slow stream of nitrogen passed through the reaction mixture. When the reflux was complete the solvent was removed by heating to 180°C/20 mm Hg. Mineral oil (72g) was added to the residue which was then filtered through a diatomaceous earth to yield a viscous orange oil soluble product.

TBN (Castrol) = 36.5

EXAMPLE 7

A mixture of dodecylphenol (262g 1 mole) hexamine (50g 0.36 moles) and mineral oil (76 g) was stirred and heated to 120°C for 3 hrs with a slow stream of nitrogen passed through the reaction mixture. The residue was filtered through a diatomaceous earth to yield an orange viscous oil soluble product.

TBN (Castrol) = 104

EXAMPLE 8

A mixture of o-t-butyl-p-cresol (351g 1.5 moles; 70% active ingredient (AI) product) and hexamine (35g 0.25 moles) was heated at 120°C for 3½ hrs with stirring and a slow stream of nitrogen was passed through the reaction mixture. The residue was filtered through a diatomaceous earth to yield a light amber oil soluble product.

TBN (Castrol) = 79.5

EXAMPLE 9

This Example demonstrates the use of phenol-hexamine condensation products as antioxidants.

A 10W/30 grade oil containing only a conventional polyisobutylenesuccinic anhydride/polyamine dispersant was tested in the Petter W-1 engine under standard conditions and the weight loss of the bearing was determined. The test was repeated with addition of a phenol-hexamine condensation product to the oil. The results are shown below:

Petter W-1 Results

| Additive (% Wt) | BWL (mgs) |
|---|---|
| None | >>1000 |
| Example 2 (1.5) | 95.5 |
| Example 1 (1.5) | 76.5 |

these results demonstrate that phenol-hexamine products act as antioxidants

EXAMPLE 10

This Example demonstrates the use of phenol-hexamine condensation products as detergents.

A 10W/30 grade oil was formulated with a polyisobutylenesuccinic anhydride/polyamine condensation product as dispersant, the amine salt of a dialkyldithiophosphoric acid as antiwear additive, and the product from the reaction of an olefin with phosphorus pentasulphide as antioxidant. This oil was tested in the Petter AV-1 engine run under standard conditions and the piston was rated in the normal way. A phenol-hexamine condensation product was added to the oil and the test was repeated. The results are shown below:

Petter AV-1 Results

| Additive (wt.%) | Land Lacquer | Groove Deposit | Groove Carbon | Under-crown | Inside Skirt |
|---|---|---|---|---|---|
| None | 6.6 | 5.6 | 9.5 | 0.0 | 9.3 |
| Example 3 (2.5) | 7.9 | 6.8 | 9.0 | 4.5 | 9.6 |
| Example 5 (2.5) | 8.3 | 8.1 | 9.5 | 2.2 | 9.6 |
| Example 4 (2.5) | 7.5 | 7.1 | 9.5 | 1.9 | 9.7 |
| Example 1 (1.5) | 7.6 | 6.8 | 9.4 | 1.6 | 9.5 |

Comparison of the result obtained from the oil with no phenol-hexamine condensation product and the other test results shows that the phenolhexamine condensation products improve piston cleanliness (i.e. the additives act as detergents).

What is claimed is:

1. A lubricating oil composition comprising a lubricating oil and the product derived from the reaction of (1) hexamethylene tetramine with (2) a phenol, a methylene bis-phenol or a sulphurised phenol provided that in said phenol, methylene bis-phenol or sulphurised phenol at least one of the 2,4 and 6 positions of the phenol aromatic ring is unsubstituted and wherein the molar ratio of (1) to (2) is from 1:10 to 2:1.

2. A composition according to claim 1 wherein the phenol has attached to the aromatic nucleus one or more groups containing hydrogen and carbon atoms.

3. A composition according to claim 2 wherein said group is an alkyl group.

4. A composition according to claim 1 wherein the total number of carbon atoms in the phenol is from 10 to 30 per molecule.

5. A composition according to claim 1 wherein the product is derived from the reaction of hexamethylene tetramine with a mixture of phenols.

6. A composition according to claim 1 wherein the molar ratio of hexamine to phenol is from 1:3 to 1:6.

7. A composition according to claim 3 wherein the hexamine and phenol have been reacted at a temperature of from 100° to 150°C.

8. A composition according to claim 1 wherein the amount of reaction product is 0.01 to 50% by weight based on the weight of lubricating oil.

9. A composition according to claim 8 wherein said amount of reaction product is 0.5 to 5.0% by weight.

* * * * *